US010660162B2

(12) United States Patent
Calesella et al.

(10) Patent No.: US 10,660,162 B2
(45) Date of Patent: May 19, 2020

(54) POWER DELIVERY SYSTEM FOR AN INDUCTION COOKTOP WITH MULTI-OUTPUT INVERTERS

(71) Applicant: WHIRLPOOL CORPORATION, Benton Harbor, MI (US)

(72) Inventors: Carlo Calesella, Castelmassa (IT); Davide Parachini, Cassano Magnago (IT); Cristiano Vito Pastore, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 465 days.

(21) Appl. No.: 15/460,705

(22) Filed: Mar. 16, 2017

(65) Prior Publication Data

US 2018/0270914 A1 Sep. 20, 2018

(51) Int. Cl.
*H05B 6/06* (2006.01)

(52) U.S. Cl.
CPC ..... *H05B 6/065* (2013.01)

(58) Field of Classification Search
CPC ..... H05B 6/065; H05B 6/06; H05B 6/062
USPC ..... 219/620
See application file for complete search history.

(56) References Cited

U.S. PATENT DOCUMENTS

| | | | |
|---|---|---|---|
| 1,141,176 | A | 6/1915 | Copeman |
| 1,380,656 | A | 6/1921 | Lauth |
| 1,405,624 | A | 2/1922 | Patterson |
| 1,598,996 | A | 9/1926 | Wheelock |
| 1,808,550 | A | 6/1931 | Harpman |
| 2,024,510 | A | 12/1935 | Crisenberry |
| 2,530,991 | A | 11/1950 | Reeves |
| 2,536,613 | A | 1/1951 | Schulze et al. |
| 2,699,912 | A | 1/1955 | Cushman |
| 2,777,407 | A | 1/1957 | Schindler |
| 2,781,038 | A | 2/1957 | Sherman |
| 2,791,366 | A | 5/1957 | Geisler |
| 2,815,018 | A | 12/1957 | Collins |

(Continued)

FOREIGN PATENT DOCUMENTS

| | | | |
|---|---|---|---|
| CA | 2365023 | A1 | 7/2002 |
| CA | 2734926 | A1 | 10/2011 |

(Continued)

OTHER PUBLICATIONS

Built-In Gas Cooktop, image post date Feb. 18, 2015, originally cited by Examiner in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.

(Continued)

*Primary Examiner* — Dana Ross
*Assistant Examiner* — Joe E Mills, Jr.
(74) *Attorney, Agent, or Firm* — Price Heneveld LLP

(57) ABSTRACT

A power delivery system and method for an induction cooktop are provided herein. A plurality of inverters are each configured to apply an output power to a plurality of induction coils electrically coupled thereto via corresponding relays. A selected inverter is operable to momentarily idle to enable commutation of a relay connected thereto. An active inverter is operable to increase its output power for the duration in which the selected inverter is idled in order to lessen power fluctuations experienced on a mains line.

20 Claims, 4 Drawing Sheets

(56) References Cited

U.S. PATENT DOCUMENTS

| | | | |
|---|---|---|---|
| 2,828,608 | A | 4/1958 | Cowlin et al. |
| 2,847,932 | A | 8/1958 | More |
| 2,930,194 | A | 5/1960 | Perkins |
| 2,934,957 | A | 5/1960 | Reinhart et al. |
| D191,085 | S | 8/1961 | Kindl et al. |
| 3,017,924 | A | 1/1962 | Jenson |
| 3,051,813 | A | 8/1962 | Busch et al. |
| 3,065,342 | A | 11/1962 | Worden |
| 3,089,407 | A | 5/1963 | Kinkle |
| 3,259,120 | A | 7/1966 | Keating |
| 3,386,431 | A | 6/1968 | Branson |
| 3,463,138 | A | 8/1969 | Lotter et al. |
| 3,489,135 | A | 1/1970 | Astrella |
| 3,548,154 | A | 12/1970 | Christiansson |
| 3,602,131 | A | 8/1971 | Dadson |
| 3,645,249 | A | 2/1972 | Henderson et al. |
| 3,691,937 | A | 9/1972 | Meek et al. |
| 3,731,035 | A | 5/1973 | Jarvis et al. |
| 3,777,985 | A | 12/1973 | Hughes et al. |
| 3,780,954 | A | 12/1973 | Genbauffs |
| 3,857,254 | A | 12/1974 | Lobel |
| 3,877,865 | A | 4/1975 | Duperow |
| 3,899,655 | A | 8/1975 | Skinner |
| D245,663 | S | 9/1977 | Gordon |
| 4,104,952 | A | 8/1978 | Brass |
| 4,112,287 | A | 9/1978 | Oates et al. |
| 4,149,518 | A | 4/1979 | Schmidt et al. |
| 4,363,956 | A | 12/1982 | Scheidler et al. |
| 4,413,610 | A | 11/1983 | Berlik |
| 4,418,456 | A | 12/1983 | Riehl |
| 4,447,711 | A | 5/1984 | Fischer |
| 4,466,789 | A | 8/1984 | Riehl |
| 4,518,346 | A | 5/1985 | Pistien |
| 4,587,946 | A | 5/1986 | Doyon et al. |
| 4,646,963 | A | 3/1987 | Delotto et al. |
| 4,654,508 | A | 3/1987 | Logel et al. |
| 4,689,961 | A | 9/1987 | Stratton |
| 4,812,624 | A | 3/1989 | Kern |
| 4,818,824 | A | 4/1989 | Dixit et al. |
| 4,846,671 | A | 7/1989 | Kwiatek |
| 4,886,043 | A | 12/1989 | Homer |
| 4,891,936 | A | 1/1990 | Shekleton et al. |
| D309,398 | S | 7/1990 | Lund |
| 4,981,416 | A | 1/1991 | Nevin et al. |
| 4,989,404 | A | 2/1991 | Shekleton |
| 5,021,762 | A | 6/1991 | Hetrick |
| 5,136,277 | A | 8/1992 | Civanelli et al. |
| 5,171,951 | A | 12/1992 | Chartrain et al. |
| D332,385 | S | 1/1993 | Adams |
| 5,190,026 | A | 3/1993 | Doty |
| 5,215,074 | A | 6/1993 | Wilson et al. |
| 5,243,172 | A | 9/1993 | Hazan et al. |
| D340,383 | S | 10/1993 | Addison et al. |
| 5,272,317 | A | 12/1993 | Ryu |
| D342,865 | S | 1/1994 | Addison et al. |
| 5,316,423 | A | 5/1994 | Kin |
| 5,397,234 | A | 3/1995 | Kwiatek |
| 5,448,036 | A | 9/1995 | Husslein et al. |
| D364,993 | S | 12/1995 | Andrea |
| 5,491,423 | A | 2/1996 | Turetta |
| D369,517 | S | 5/1996 | Ferlin |
| 5,546,927 | A | 8/1996 | Lancelot |
| 5,571,434 | A | 11/1996 | Cavener et al. |
| D378,578 | S | 3/1997 | Eberhardt |
| 5,618,458 | A | 4/1997 | Thomas |
| 5,640,497 | A | 6/1997 | Shute |
| 5,649,822 | A | 7/1997 | Gertler et al. |
| 5,735,261 | A | 4/1998 | Kieslinger |
| 5,785,047 | A | 7/1998 | Bird et al. |
| 5,842,849 | A | 12/1998 | Huang |
| 5,913,675 | A | 6/1999 | Vago et al. |
| 5,928,540 | A | 7/1999 | Antoine et al. |
| D414,377 | S | 9/1999 | Huang |
| 5,967,021 | A | 10/1999 | Yung |
| 6,016,096 | A | 1/2000 | Barnes et al. |
| 6,030,207 | A | 2/2000 | Saleri |
| 6,049,267 | A | 4/2000 | Barnes et al. |
| 6,050,176 | A | 4/2000 | Schultheis et al. |
| 6,078,243 | A | 6/2000 | Barnes et al. |
| 6,089,219 | A | 7/2000 | Kodera et al. |
| 6,092,518 | A | 7/2000 | Dane |
| 6,111,229 | A | 8/2000 | Schultheis |
| 6,114,665 | A | 9/2000 | Garcia et al. |
| 6,133,816 | A | 10/2000 | Barnes et al. |
| 6,155,820 | A | 12/2000 | Döbbeling |
| 6,188,045 | B1 | 2/2001 | Hansen et al. |
| 6,192,669 | B1 | 2/2001 | Keller et al. |
| 6,196,113 | B1 | 3/2001 | Yung |
| 6,253,759 | B1 | 7/2001 | Giebel et al. |
| 6,253,761 | B1 | 7/2001 | Shuler et al. |
| 6,320,169 | B1 | 11/2001 | Clothier |
| 6,322,354 | B1 | 11/2001 | Carbone et al. |
| 6,362,458 | B1 | 3/2002 | Sargunam et al. |
| 6,452,136 | B1 | 9/2002 | Berkcan et al. |
| 6,452,141 | B1 | 9/2002 | Shon |
| 6,589,046 | B2 | 7/2003 | Harneit |
| 6,614,006 | B2 | 9/2003 | Pastore et al. |
| 6,619,280 | B1 | 9/2003 | Zhou et al. |
| 6,655,954 | B2 | 12/2003 | Dane |
| 6,663,009 | B1 | 12/2003 | Bedetti et al. |
| 6,718,965 | B2 | 4/2004 | Rummel et al. |
| 6,733,146 | B1 | 5/2004 | Vastano |
| 6,806,444 | B2 | 10/2004 | Lerner |
| 6,837,151 | B2 | 1/2005 | Chen |
| 6,891,133 | B2 | 5/2005 | Shozo et al. |
| 6,910,342 | B2 | 6/2005 | Berns et al. |
| 6,930,287 | B2 | 8/2005 | Gerola et al. |
| 6,953,915 | B2 | 10/2005 | Garris, III |
| 7,005,614 | B2 | 2/2006 | Lee |
| 7,017,572 | B2 | 3/2006 | Cadima |
| D524,105 | S | 7/2006 | Poltronieri |
| 7,083,123 | B2 | 8/2006 | Molla |
| 7,220,945 | B1 | 5/2007 | Wang |
| D544,753 | S | 6/2007 | Tseng |
| 7,274,008 | B2 | 9/2007 | Arnal Valero et al. |
| 7,281,715 | B2 | 10/2007 | Boswell |
| 7,291,009 | B2 | 11/2007 | Kamal et al. |
| 7,315,247 | B2 | 1/2008 | Jung et al. |
| 7,325,480 | B2 | 2/2008 | Grühbaum et al. |
| D564,296 | S | 3/2008 | Koch et al. |
| 7,348,520 | B2 | 3/2008 | Wang |
| 7,368,685 | B2 | 5/2008 | Nam et al. |
| 7,411,160 | B2 | 8/2008 | Duncan et al. |
| 7,414,203 | B2 | 8/2008 | Winkler |
| 7,417,204 | B2 | 8/2008 | Nam et al. |
| 7,429,021 | B2 | 9/2008 | Sather et al. |
| D581,736 | S | 12/2008 | Besseas |
| 7,468,496 | B2 | 12/2008 | Marchand |
| D592,445 | S | 5/2009 | Sorenson et al. |
| 7,527,495 | B2 | 5/2009 | Yam et al. |
| D598,959 | S | 8/2009 | Kiddoo |
| 7,589,299 | B2 | 9/2009 | Fisher et al. |
| D604,098 | S | 11/2009 | Hamlin |
| 7,614,877 | B2 | 11/2009 | McCrorey et al. |
| 7,628,609 | B2 | 12/2009 | Pryor et al. |
| 7,640,930 | B2 | 1/2010 | Little et al. |
| 7,696,454 | B2 | 4/2010 | Nam et al. |
| 7,708,008 | B2 | 5/2010 | Elkasevic et al. |
| 7,721,727 | B2 | 5/2010 | Kobayashi |
| 7,731,493 | B2 | 6/2010 | Starnini et al. |
| 7,762,250 | B2 | 7/2010 | Elkasevic et al. |
| 7,770,985 | B2 | 8/2010 | Davis et al. |
| 7,781,702 | B2 | 8/2010 | Nam et al. |
| 7,823,502 | B2 | 11/2010 | Hecker et al. |
| 7,829,825 | B2 | 11/2010 | Kühne |
| 7,840,740 | B2 | 11/2010 | Minoo |
| 7,841,333 | B2 | 11/2010 | Kobayashi |
| 7,964,823 | B2 | 6/2011 | Armstrong et al. |
| D642,675 | S | 8/2011 | Scribano et al. |
| 8,006,687 | B2 | 8/2011 | Watkins et al. |
| 8,015,821 | B2 | 9/2011 | Spytek |
| 8,037,689 | B2 | 10/2011 | Oskin et al. |
| 8,057,223 | B2 | 11/2011 | Pryor et al. |
| 8,141,549 | B2 | 3/2012 | Armstrong et al. |

(56) References Cited

U.S. PATENT DOCUMENTS 8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,356,367 B2 1/2013 Flynn
8,393,317 B2 3/2013 Sorenson et al.
8,398,303 B2 3/2013 Kuhn
8,430,310 B1 4/2013 Ho et al.
8,464,703 B2 6/2013 Ryu et al.
D685,225 S 7/2013 Santoyo et al.
D687,675 S 8/2013 Filho et al.
8,526,935 B2 9/2013 Besore et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hassiberger et al.
8,747,108 B2 6/2014 Lona Santoyo et al.
8,791,398 B2 * 7/2014 De la Cuerda Ortin ..... H05B 6/062 219/620
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Arnal Valero et al.
9,132,302 B2 9/2015 Luongo et al.
D743,203 S 11/2015 Filho et al.
9,175,858 B2 11/2015 Tisselli et al.
D750,314 S 2/2016 Hobson et al.
9,307,888 B2 4/2016 Baldwin et al.
D758,107 S 6/2016 Hamilton
9,400,115 B2 7/2016 Kuwamura
D766,036 S 9/2016 Koch et al.
D766,696 S 9/2016 Kemker
9,513,015 B2 12/2016 Estrella et al.
9,521,708 B2 12/2016 Adelmann et al.
9,557,063 B2 1/2017 Cadima
9,572,475 B2 2/2017 Gephart et al.
9,644,847 B2 5/2017 Bhogal et al.
9,696,042 B2 7/2017 Hasslberger et al.
9,879,864 B2 1/2018 Gutierrez et al.
9,927,129 B2 3/2018 Bhogal et al.
2002/0065039 A1 5/2002 Benezech et al.
2004/0007566 A1 1/2004 Staebler et al.
2004/0031782 A1 2/2004 Westfield
2004/0195399 A1 10/2004 Molla
2004/0224273 A1 11/2004 Inomata
2004/0224274 A1 11/2004 Tomiura
2005/0029245 A1 2/2005 Gerola et al.
2005/0112520 A1 5/2005 Todoli et al.
2005/0199232 A1 9/2005 Gama et al.
2005/0268000 A1 12/2005 Carlson
2005/0268794 A1 12/2005 Nesterov
2007/0124972 A1 6/2007 Ratcliffe
2007/0181410 A1 8/2007 Baier
2007/0251936 A1 11/2007 Nam et al.
2007/0281267 A1 12/2007 Li
2008/0029081 A1 2/2008 Gagas
2008/0050687 A1 2/2008 Wu
2008/0173632 A1 7/2008 Jang et al.
2008/0210685 A1 9/2008 Beier
2009/0173730 A1 7/2009 Baier et al.
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0154776 A1 6/2010 Czajka et al.
2010/0192939 A1 8/2010 Parks
2011/0027733 A1 2/2011 Yamamoto et al.
2011/0142998 A1 6/2011 Johncook et al.
2011/0163086 A1 7/2011 Aldana Arjol et al.
2011/0248021 A1 10/2011 Gutierrez et al.
2012/0017595 A1 1/2012 Liu
2012/0024835 A1 2/2012 Artal Lahoz et al.
2012/0036855 A1 2/2012 Hull
2012/0067334 A1 3/2012 Kim et al.
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0087554 A1 4/2013 Anton et al.
2013/0252188 A1 9/2013 Chen
2013/0255663 A1 10/2013 Cadima et al.
2013/0260618 A1 10/2013 Bally et al.
2014/0048055 A1 2/2014 Ruther
2014/0071019 A1 3/2014 Lim
2014/0090636 A1 4/2014 Bettinzoli
2014/0097172 A1 4/2014 Kang et al.
2014/0116416 A1 5/2014 Saubert
2014/0137751 A1 5/2014 Bellm
2014/0139381 A1 5/2014 Sippel
2014/0318527 A1 10/2014 Silva et al.
2014/0352549 A1 12/2014 Upston et al.
2015/0096974 A1 4/2015 Freeman et al.
2015/0136760 A1 5/2015 Lima et al.
2015/0153041 A1 6/2015 Neumeier
2015/0241069 A1 8/2015 Brant et al.
2015/0330640 A1 11/2015 Stork genannt Wersborg
2015/0345800 A1 12/2015 Cabrera Botello
2015/0359045 A1 12/2015 Neukamm et al.
2016/0029439 A1 1/2016 Kurose et al.
2016/0061490 A1 3/2016 Cho et al.
2016/0091210 A1 3/2016 Ceccoli
2016/0095469 A1 4/2016 Gregory et al.
2016/0116160 A1 4/2016 Takeuchi
2016/0153666 A1 6/2016 Tcaciuc
2016/0174768 A1 6/2016 Deverse
2016/0178209 A1 6/2016 Park et al.
2016/0178212 A1 6/2016 Park et al.
2016/0187002 A1 6/2016 Ryu et al.
2016/0201902 A1 7/2016 Cadima
2016/0209044 A1 7/2016 Cadima
2016/0209045 A1 7/2016 Millius
2016/0295644 A1 10/2016 Khokle et al.
2016/0296067 A1 10/2016 Laws
2016/0323937 A1 11/2016 Anton et al.
2017/0003033 A1 1/2017 Lona Santoyo et al.
2017/0067651 A1 3/2017 Khokle et al.
2017/0074522 A1 3/2017 Cheng
2017/0082296 A1 3/2017 Jeong et al.
2017/0082299 A1 3/2017 Rowley et al.
2017/0108228 A1 4/2017 Park et al.
2017/0115008 A1 4/2017 Erbe et al.
2017/0261213 A1 4/2017 Park et al.
2017/0223774 A1 8/2017 Cheng et al.
2018/0058702 A1 3/2018 Jang et al.

FOREIGN PATENT DOCUMENTS

CN 201680430 U 12/2010
DE 7242625 3/1973
DE 2845869 A1 4/1980
DE 3014908 A1 10/1981
DE 3238441 A1 4/1984

(56) References Cited

FOREIGN PATENT DOCUMENTS

| | | | |
|---|---|---|---|
| DE | 3446621 | A1 | 6/1986 |
| DE | 3717728 | A1 | 12/1988 |
| DE | 3150450 | C2 | 8/1989 |
| DE | 3839657 | A1 | 5/1990 |
| DE | 4103664 | C1 | 1/1992 |
| DE | 4228076 | | 5/1993 |
| DE | 4445594 | A1 | 6/1996 |
| DE | 10218294 | A1 | 11/2003 |
| DE | 60004581 | T2 | 6/2004 |
| DE | 102004002466 | A1 | 8/2005 |
| DE | 1020040009606 | | 9/2005 |
| DE | 102005059505 | A1 | 6/2007 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102008042467 | A1 | 4/2010 |
| DE | 102008051829 | A1 | 4/2010 |
| DE | 102009002276 | A1 | 10/2010 |
| DE | 102013218714 | A1 | 4/2014 |
| EP | 0000908 | A1 | 3/1979 |
| EP | 0122966 | A2 | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | A2 | 6/2002 |
| EP | 1344986 | A1 | 9/2003 |
| EP | 1586822 | A1 | 10/2005 |
| EP | 1617148 | A1 | 1/2006 |
| EP | 1099905 | B1 | 2/2006 |
| EP | 1201998 | B1 | 3/2006 |
| EP | 1460342 | B1 | 5/2006 |
| EP | 2063181 | A2 | 5/2009 |
| EP | 2063444 | A1 | 5/2009 |
| EP | 2070442 | | 6/2009 |
| EP | 2116775 | A1 | 11/2009 |
| EP | 2116829 | A1 | 11/2009 |
| EP | 2278227 | A2 | 1/2011 |
| EP | 2299181 | A1 | 3/2011 |
| EP | 2375170 | A1 | 10/2011 |
| EP | 2144012 | B1 | 9/2012 |
| EP | 2657615 | A1 | 10/2013 |
| EP | 2816291 | A1 | 12/2014 |
| EP | 2835580 | A2 | 2/2015 |
| EP | 3006832 | A1 | 4/2016 |
| EP | 3123819 | | 2/2017 |
| EP | 2848867 | B1 | 9/2017 |
| FR | 2712071 | | 5/1995 |
| FR | 2787556 | A1 | 6/2000 |
| FR | 2789753 | A1 | 8/2000 |
| FR | 3003338 | A1 | 9/2014 |
| GB | 2158225 | A | 11/1985 |
| JP | 2001141244 | A | 5/2001 |
| JP | 2005009693 | A | 1/2005 |
| JP | 2007147131 | A | 6/2007 |
| JP | 2010038475 | A | 2/2010 |
| JP | 2011144982 | A | 7/2011 |
| JP | 2011257021 | A | 12/2011 |
| WO | 1991013526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013104521 | A1 | 7/2013 |
| WO | 2013182410 | A1 | 12/2013 |
| WO | 2014194176 | A1 | 12/2014 |
| WO | 2015086420 | A1 | 6/2015 |

OTHER PUBLICATIONS

True-Heat burner, image post date Jan. 30, 2015, originally cited by Examiner in U.S. Appl. No. 29/539,768 in Restriction Requirement dated Oct. 27, 2016, 2 pages, <http://ovens.reviewed.com/news/kitchenaid-has-a-new-flame>.

Metal Cover Gas Hob, image post date 2012, originally cited by Examiner in U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, originally cited by Examiner in U.S. Appl. No. 29/539,768 in Restriction Requirement dated Oct. 27, 2016, 30 pages, <http://www.jureystudio.com/pennystove/stoveinstruction.html>.

* cited by examiner

POWER DELIVERY SYSTEM FOR AN INDUCTION COOKTOP WITH MULTI-OUTPUT INVERTERS

FIELD OF THE INVENTION

The present invention generally relates to induction cooktops, and more particularly, to a power delivery system for an induction cooktop having high frequency inverters applying output power to multiple induction coils.

BACKGROUND OF THE INVENTION

Induction cooktops typically employ high frequency inverters to apply power to induction coils in order to heat a load. In induction cooktops having inverters that each apply power to multiple induction coils, a common drawback is the fluctuation of power experienced on a mains line during power balancing of the induction coils. Accordingly, there is a need for a power delivery system that lessens power fluctuations experienced on the mains line.

SUMMARY OF THE INVENTION

According to one aspect of the present invention, a power delivery system for an induction cooktop is provided herein. A plurality of inverters are each configured to apply an output power to a plurality of induction coils electrically coupled thereto via corresponding relays. A selected inverter is operable to momentarily idle to enable commutation of a relay connected thereto. An active inverter is operable to increase its output power for the duration in which the selected inverter is idled in order to lessen power fluctuations experienced on a mains line.

According to another aspect of the present invention, an induction cooktop is provided including a plurality of induction coils. A plurality of relays are each connected to a corresponding induction coil. A plurality of inverters are each connected to more than one relay and are each configured to apply an output power to the corresponding induction coils. At least one selected inverter is operable to momentarily idle to enable commutation of a relay connected thereto. At least one active inverter is operable to increase its output power for the duration in which the at least one selected inverter is idled in order to lessen power fluctuations experienced on a mains line.

According to yet another aspect of the present invention, a power delivery method for an induction cooktop is provided. The method includes the steps of: providing a plurality of inverters, each of which is configured to apply an output power to a plurality of induction coils electrically coupled thereto via corresponding relays; momentarily idling a selected inverter to enable commutation of a relay connected thereto; and increasing an output power of an active inverter for the duration in which the selected inverter is idled in order to lessen power fluctuations experienced on a mains line.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein.

However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
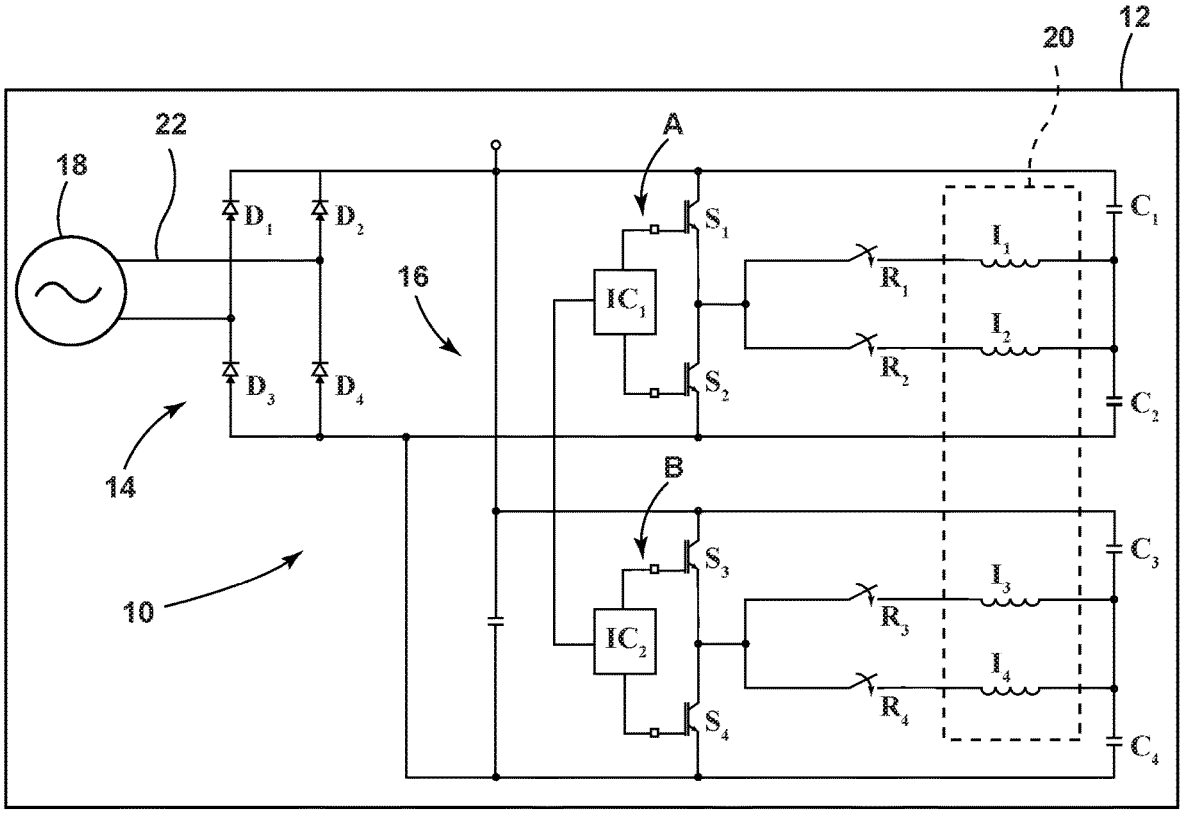
FIG. 1 is a circuit diagram of a power delivery system for an induction cooktop, the power delivery system having high frequency inverters configured to apply output power to multiple induction coils.

Referring to FIG. 1, a power delivery system 10 is shown for an induction cooktop generally designated by reference numeral 12. The power delivery system 10 may include a rectifier 14, a DC bus 16, and a plurality of high frequency inverters exemplarily shown as inverters A and B. In the depicted embodiment, the rectifier 14 is electrically coupled to AC mains 18 and is configured to convert AC voltage into DC voltage. The rectifier 14 may include diodes $D_1$-$D_4$ arranged in a conventional full-wave diode bridge configuration. Alternatively, the rectifier 14 may include a bridge configuration having silicon-controlled rectifiers (SCRs) or insulated gate bipolar transistors (IGBTs). The DC bus 16 is electrically coupled to the rectifier 14 and is configured to stabilize and smooth rectifier output using one or more capacitors, inductors, or a combination thereof.

Inverters A and B are electrically coupled to the DC bus 16 and are configured to convert DC voltage back into AC voltage. Inverters A and B may each include a pair of electronic switches controlled by one or more microcontrollers using pulse width modulation (PWM) to perform the DC to AC conversion and generate inverter output. In the depicted embodiment, inverter A includes switches $S_1$ and $S_2$ while inverter B includes switches $S_3$ and $S_4$. Switches $S_1$-$S_4$ may be configured as IGBTs or any other switch commonly employed in high frequency inverters. Although the inverters A, B are shown as having a series resonant half-bridge topology, it is to be understood that other inverter topologies may be otherwise adopted such as, but not limited to, full bridge, single-switch quasi-resonant, or active-clamped quasiresonant.

Switches $S_1$ and $S_2$ may be controlled by microcontroller $IC_1$ and switches $S_3$ and $S_4$ may be controlled by microcontroller $IC_2$. Microcontrollers $IC_1$ and $IC_2$ may be in electrical communication to operate the switches $S_1$-$S_4$ accordingly during a PWM control scheme. Alternatively, a single microcontroller IC may be provided to control switches $S_1$-$S_4$. For the sake of clarity and simplicity, only two inverters A, B are shown in FIG. 1. However, it will be understood that additional inverters may be similarly provided in alternative embodiments.

With continued reference to FIG. 1, a plurality of induction coils $I_1$-$I_4$ are provided and are operable to heat one or more loads placed on a heating area 20 of the induction cooktop 12. In the depicted embodiment, induction coils $I_1$ and $I_2$ are each electrically coupled to the output of inverter A via a series connection with a corresponding electromechanical relay $R_1$, $R_2$. Relays $R_1$ and $R_2$ are operable between an opened and a closed position to determine an activation state of the corresponding induction coil $I_1$, $I_2$. Induction coils $I_1$ and $I_2$ are also electrically coupled to capacitors $C_1$ and $C_2$ to establish a resonant load for the electronic switches $S_1$, $S_2$ of inverter A. Similarly, induction coils $I_3$ and $I_4$ are each electrically coupled to the output of inverter B via a series connection with a corresponding electromechanical relay $R_3$, $R_4$, each operable between an opened and a closed position to determine an activation state of the corresponding induction coil $I_3$, $I_4$. Induction coils $I_3$ and $I_4$ are also electrically coupled to capacitors $C_3$ and $C_4$ to establish a resonant load for the electronic switches $S_3$, $S_4$ of inverter B. While capacitors $C_1$ and $C_2$ are depicted as being shared between induction coils $I_1$ and $I_2$, it will be appreciated that separate capacitors may be uniquely assigned to each of the induction coils $I_1$, $I_2$ in alternative embodiments. The same is true with respect to the arrangement between induction $I_3$ and $I_4$ and capacitors $C_3$ and $C_4$.

Generally speaking, electromechanical relays are preferable over solid state solutions due to favorable characteristics such as lower heat dissipation, lower cost, and lower physical volume. In order to operate reliably, electromechanical relays are typically commutated at zero current. Otherwise, the service life of the electromechanical relays may be inadequate for use in household applications. With respect to the depicted embodiment, commutation at zero current is achieved by opening or closing a selected relay(s) $R_1$-$R_4$ during a momentary idling of the corresponding inverter A, B. This idling process is referred to herein as "idle-before-make." During the idle-before-make process, the corresponding inverter A, B is typically deactivated for some tens of milliseconds, which may lead to large power fluctuations on a mains line 22. Since larger power fluctuations typically require longer control periods in order to comply with regulatory standards (e.g., standard IEC 61000-3-2), one concern is that when the inverters A, B are operated near full power (e.g., 3600 W for a 16A phase), an idle-before-make process may provoke a power fluctuation requiring a corresponding control period to be in the order of minutes, which is undesirable from a power uniformity standpoint. Furthermore, large power fluctuations may induce flicker on the mains line 22.

Figure 2:
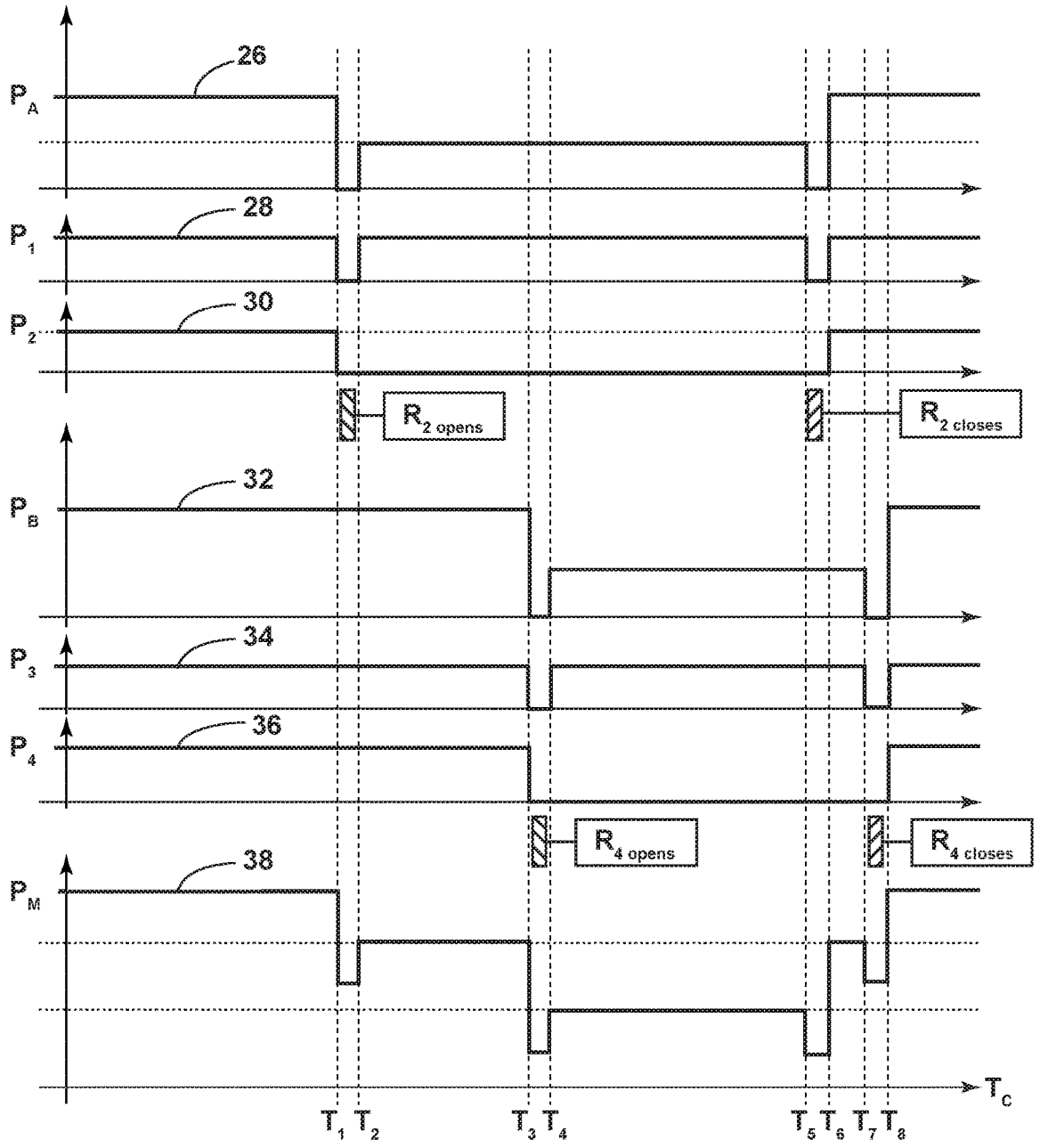
FIG. 2 is an exemplary pulse width modulation scheme illustrating the output power of the inverters over a control period and the resulting power fluctuations on a mains line caused by an uncompensated power drop experienced during the idling of a selected inverter in order to commutate a relay connected thereto.

To better understand the foregoing principles, reference is made to FIG. 2, which illustrates an exemplary PWM control scheme 24 using inverters A and B under the control of microcontrollers $IC_1$ and $IC_2$. In the depicted embodiment, line 26 represents an output power $P_A$ of inverter A applied to induction coils $I_1$ and/or $I_2$ over the course of a control period $T_c$ that includes times $T_1$-$T_8$. With respect to the embodiments described herein, it is understood that the control period $T_c$ may end at time $T_8$ or otherwise continue beyond time $T_8$.

For reference, line 28 represents an output power $P_1$ of inverter A applied exclusively to induction coil $I_1$ over the course of the control period $T_c$, and line 30 represents an output power $P_2$ of inverter A applied exclusively to induction coil $I_2$ over the course of the control period $T_c$. Since inverter A supplies power to both induction coils $I_1$ and $I_2$, it will be understood that the output power $P_A$ of inverter A corresponds to a sum of the instantaneous output powers $P_1$, $P_2$ applied to induction coils $I_1$ and $I_2$.

Likewise, line 32 represents an output power $P_B$ of inverter B applied to induction coils $I_3$ and/or $I_4$ over the course of the control period $T_c$. For reference, line 34 represents an output power $P_3$ of inverter B applied exclusively to induction coil $I_3$ over the course of the control period $T_c$, and line 36 represents an output power $P_4$ of inverter B applied exclusively to induction coil $I_4$ over the course of the control period $T_c$. Since inverter B supplies power to both induction coils $I_3$ and $I_4$, it will be understood that the output power $P_B$ of inverter B corresponds to the instantaneous output powers $P_3$, $P_4$ applied to induction coils $I_3$ and $I_4$.

Lastly, line 38 represents the fluctuation of power $P_m$ on the mains line 22 over the course of the control period $T_c$. Since the mains line 22 is responsible for supplying power to inverters A and B, it follows that the fluctuation experienced by the mains line 22 is the sum of the instantaneous output powers $P_A$, $P_B$ of inverters A and B, or equivalently, the sum of the instantaneous output powers $P_1$-$P_4$ applied to induction coils $I_1$-$I_4$. As a consequence, if one or more of the relays $R_1$-$R_4$ are commutated for the purposes of adjusting power between the induction coils $I_1$-$I_4$, a power fluctuation will be experienced by the mains line 22 as a result of the corresponding inverter A, B being momentarily idled.

For example, inverter A is momentarily idled between times $T_1$ and $T_2$ and again between times $T_5$ and $T_6$ in order to commutate relay $R_2$ at zero current. Specifically, relay $R_2$ is opened while inverter A is momentarily idled between times $T_1$ and $T_2$ in order to deactivate induction coil $I_2$, and closed while inverter A is momentarily idled between times $T_5$ and $T_6$ in order to reactivate induction coil $I_2$. During each momentary idling of inverter A, output powers $P_1$ and $P_2$ cease to be applied to induction coils $I_1$ and $I_2$, respectively, and as a result, the instantaneous output power $P_A$ of inverter A is zero between times $T_1$ and $T_2$, and times $T_5$ and $T_6$, thereby causing a corresponding power fluctuation to be experienced in the mains line 22 during those time intervals.

As a further example, inverter B is momentarily idled between times $T_3$ and $T_4$ and again between times $T_7$ and $T_8$ in order to commutate relay $R_4$ at zero current. Specifically, relay $R_4$ is opened while inverter B is momentarily idled between times $T_3$ and $T_4$ in order to deactivate induction coil $I_4$, and closed while inverter B is momentarily idled between times $T_7$ and $T_8$ in order to reactivate induction coil $I_4$. During each momentary idling of inverter B, output powers $P_3$ and $P_4$ cease to be applied to induction coils $I_3$ and $I_4$, respectively, and as a result, the instantaneous output power $P_B$ of inverter B is zero between times $T_3$ and $T_4$, and times $T_7$ and $T_8$, thereby causing a corresponding power fluctuation to be experienced in the mains line 22 during those time intervals.

In view of the above, a solution is provided herein to mitigate power fluctuation on the mains line 22. Specifically, in instances where a selected inverter(s) is momentarily idled in order to commutate a relay connected thereto at zero current, it is contemplated that at least one active inverter is operable to increase output power for the duration in which the selected inverter(s) is idled. The increased output power of the active inverter is applied to active induction coils associated therewith. During the idling of the selected inverter, the output power of an active inverter(s) is increased by an additional output power that may be predetermined or based on a pre-idle output power of the selected inverter(s). The additional output power may be equal to or less than a pre-idle output power of the selected inverter(s) that is applied to an associated induction coil(s) that was active before and remains active after the idling of the selected inverter(s), or in other words, maintains an electrical connection with the selected inverter(s) due to its corresponding relay remaining closed throughout the idling of the selected inverter(s). By increasing the output power of active inverters during an idle-before-make process, the resultant drop off in output power of an idled inverter is compensated, thereby lessening the corresponding power fluctuation experienced on the mains line 22.

Figure 3:
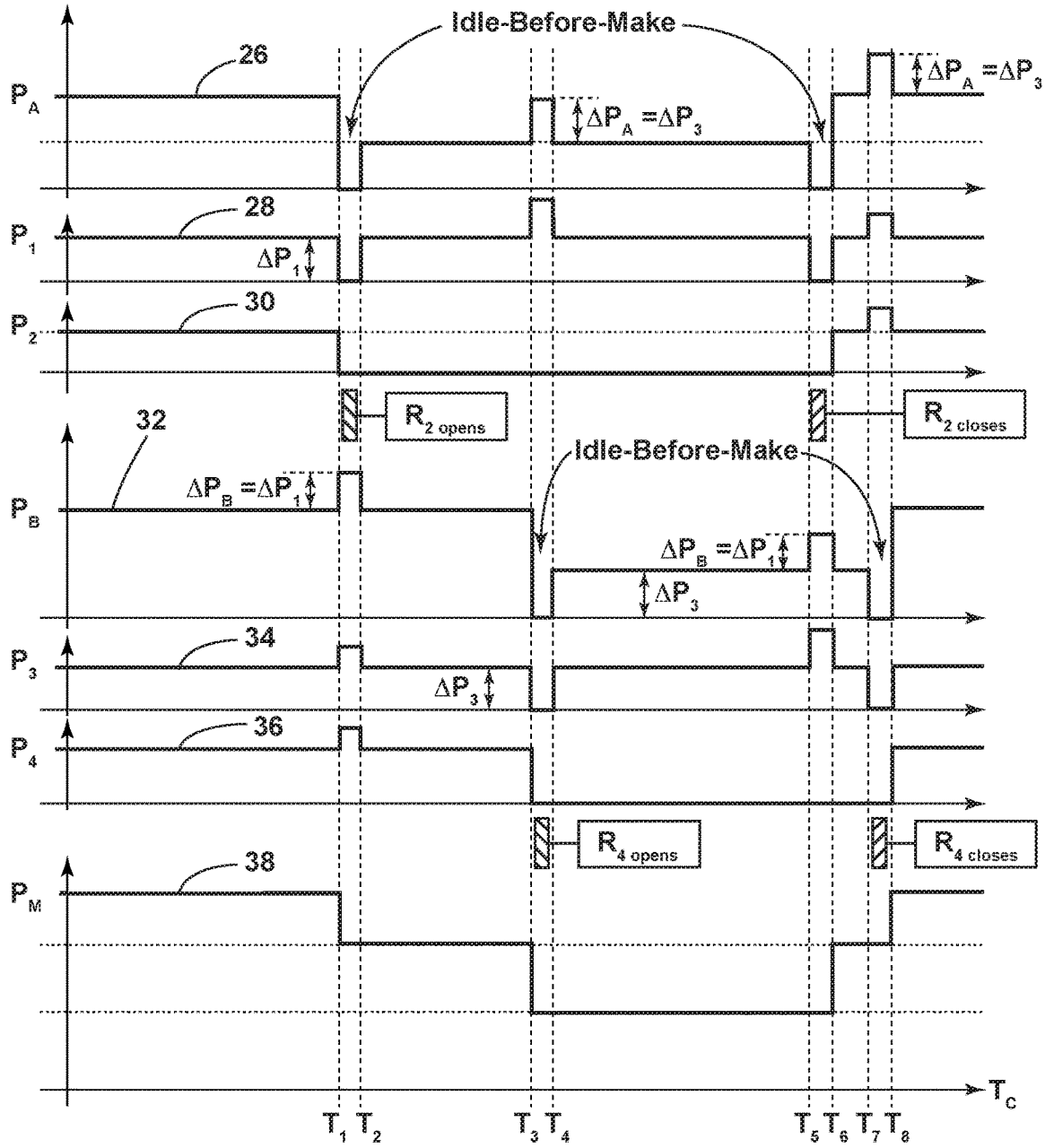
FIG. 3 again illustrates the output power of the inverters over the control period, wherein the inverters are configured to fully compensate the power drop in order to lessen power fluctuations on the mains line.
Figure 4:
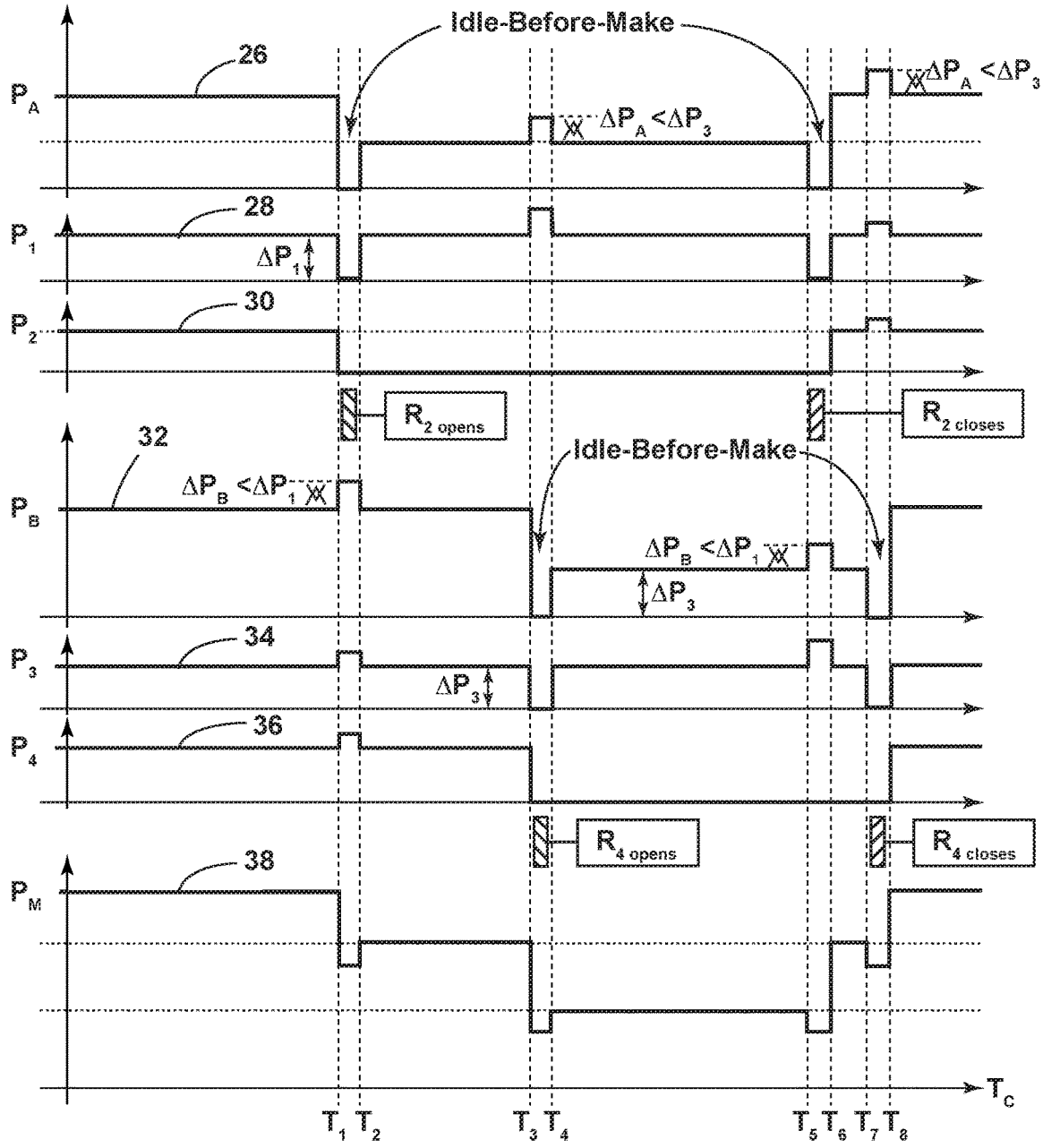
FIG. 4 yet again illustrates the output power of the inverters over the control period, wherein the inverters are configured to partially compensate the power drop in order to lessen power fluctuations on the mains line.

For purposes of understanding, the PWM control scheme 24 is again illustrated in FIGS. 3 and 4, only this time, inverter B is operable to compensate for power fluctuation on the mains line 22 by increasing output power $P_8$ for the duration in which inverter A is momentarily idled between times $T_1$ and $T_2$, and between times $T_5$ and $T_6$, during which relay $R_2$ is commutated at zero current. Specifically, the output power $P_B$ is increased by an additional output power $\Delta P_B$ that is equal to (FIG. 3) or less than (FIG. 4) a pre-idle output power $\Delta P_1$ of inverter A that is applied to induction coil $I_1$. In embodiments where an additional induction coil(s) is connected to inverter A and maintains an electrical connection therewith throughout the idle-before-make process, the additional output power $\Delta P_B$ may be equal to or less than the sum of the pre-idle output power $\Delta P_1$ applied to induction coil $I_1$ and the pre-idle output power applied to the additional induction coil(s). As shown in FIGS. 3 and 4, the increased output power ($P_B+\Delta P_B$) is applied to active induction coils $I_3$ and $I_4$ between times $T_1$ and $T_2$, and is applied exclusively to induction coil $I_3$ between times $T_5$ to $T_6$ due to induction coil $I_4$ being inactive between times $T_5$ to $T_6$.

Likewise, inverter A is operable to compensate for power fluctuation on the mains line 22 by increasing output power $P_A$ for the duration in which inverter B is momentarily idled between times $T_3$ and $T_4$, and between times $T_7$ and $T_8$, during which relay $R_4$ is commutated at zero current. Specifically, the output power PA is increased by an additional output power $\Delta P_A$ that is equal to (FIG. 3) or less than (FIG. 4) a pre-idle output power $\Delta P_3$ of inverter B that is applied to induction coil $I_3$. In embodiments where an additional induction coil(s) is connected to inverter B and maintains an electrical connection therewith throughout the idle-before-make process, the additional output power $\Delta P_A$ may be equal to or less than the sum of the pre-idle output power $\Delta P_3$ applied to induction coil $I_3$ and the pre-idle output power applied to the additional induction coil(s). As shown in FIGS. 3 and 4, the increased output power ($P_A+\Delta P_A$) is applied exclusively to induction coil $I_1$ between times $T_3$ and $T_4$ due to induction coil $I_2$ being inactive between times $T_3$ and $T_4$, and is applied to induction coils $I_1$ and $I_2$ between times $T_7$ and $T_8$.

When FIGS. 3 and 4 are compared to FIG. 2, in which inverters A and B provide no compensation, the corresponding power fluctuation experienced by the mains line 22 between times $T_1$ and $T_2$, $T_3$ and $T_4$, $T_5$ and $T_6$, and $T_7$ and $T_8$ is lessened, especially when inverters A and B are configured in the manner described with reference to FIG. 3. While less compensation is achieved when inverters A and B are configured in the manner described with reference to FIG. 4, a power delivery system employing such inverters A, B is still preferable over one in which the inverters offer no compensation.

Regarding the embodiments shown in FIGS. 2-4, the duration in which inverters A and B are idled may be set equal to an integer number of mains half-cycles (e.g., 30 ms or 40 ms in a 50 Hz system) and may be synchronized with mains voltage zero crossings.

With respect to the embodiments shown in FIGS. 3 and 4, the output power $P_A$, $P_B$ of inverters A and B may be reduced over the course of the control period $T_c$ to offset the additional power $\Delta P_A$, $\Delta P_B$ applied during idle-before-make processes. For example, inverters A and B both deliver an excess energy determined using the following equation:

$$E_{excess}=C\cdot\Delta AP\cdot T \tag{1}$$

In regards to equation 1, $E_{xcess}$ denotes the excess energy delivered by a particular inverter, C is a variable denoting the number of times an additional power was applied by the inverter over the control period $T_c$, $\Delta P$ denotes the additional power applied by the inverter, and T denotes the duration in which the additional power was applied by the inverter and is typically equal to the duration of an idle-before-make process.

With respect to inverters A and B, equation 1 can be rewritten as follows:

$$E_{excess}=2\cdot\Delta P_A\cdot T \tag{2}$$

$$E_{excess}=2\cdot\Delta P_B\cdot T \tag{3}$$

Equation 2 allows for the excess energy of inverter A to be computed and equation 3 allows for the excess energy of inverter B to be computed. In both equations, variable C is equal to 2 due to inverters A and B twice applying their respective additional powers $\Delta P_A$, $\Delta P_B$ over the course of the control period $T_c$.

Having determined the excess energy delivered by inverters A and B, the amount by which their output powers $P_A$, $P_B$ are reduced over the course of the control period $T_c$ is determined by taking the quotient between the corresponding excess energy and the control period $T_c$. It is contemplated that the reduction in output power $P_A$, $P_B$ of inverters A and B may be implemented during one or more time intervals that are free of an idle-before-make process. For example, with respect to the embodiments shown in FIGS. 3 and 4, such time intervals include the start of the control period $T_c$ to $T_1$, $T_2$ to $T_3$, $T_4$ to $T_5$, and $T_6$ to $T_7$.

Generally speaking, the duration T is relatively short compared to that of the control period $T_c$. Accordingly, the need to reduce output power for inverters applying one or more additional powers over the course of the control period $T_c$ may be neglected without adversely impacting power balance between the inverters.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described disclosure, and other components, is not limited to any specific material. Other exemplary embodiments of the disclosure disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise. Further, the claims, as set forth below, are incorporated into and constitute part of this Detailed Description.

What is claimed is:

1. A power delivery system for an induction cooktop, comprising:

a plurality of inverters, each of which is configured to apply an output power to a plurality of induction coils electrically coupled thereto via corresponding relays;

a controller configured to:

control a selected inverter to momentarily enter an idle state;

in response to the idle state, control a commutation of a relay connected thereto; and control an active inverter to increase an output power for the duration in which the selected inverter is in the idle state, thereby decreasing power fluctuations on a mains line.

2. The power delivery system of claim 1, wherein the controller is further configured to:

increase the output power applied to each of a plurality of active induction coils associated with the active inverter.

3. The power delivery system of claim 1, wherein during the idling of the selected inverter, the controller is configured to increase the output power of the active inverter by an additional output power that is based on a pre-idle output power of the selected inverter.

4. The power delivery system of claim 3, wherein the additional output power is equal to the pre-idle output power of the selected inverter that is applied to at least one associated induction coil that was active before and remains active after the idling of the selected inverter.

5. The power delivery system of claim 3, wherein the additional output power is less than the pre-idle output power of the selected inverter that is applied to at least one associated induction coil that was active before and remains active after the idling of the selected inverter.

6. The power delivery system of claim 3, wherein the controller is further configured to:

decrease the output power of the active inverter over the course of a control period, thereby offsetting the additional power applied during the idling of the selected inverter.

7. The power delivery system of claim 1, wherein the duration in which the selected inverter is idled is set equal to an integer number of mains half-cycles of a mains voltage supplied to the induction cooktop and is synchronized with a mains voltage zero crossings.

8. An induction cooktop comprising:

a plurality of induction coils;

a plurality of relays, each of which is connected to a corresponding induction coil;

a plurality of inverters, each of which is connected to more than one relay and configured to apply an output power to the corresponding induction coils;

a controller configured to:

control at least one selected inverter to momentarily idle and enable a commutation of a relay connected thereto, wherein the timing in which the at least one selected inverter is idled is synchronized with a mains voltage zero crossing of a mains voltage supplied to the induction cooktop; and control at least one active inverter to increase an output power for the duration in which the at least one selected inverter is idled decreasing power fluctuations experienced on the mains line.

9. The induction cooktop of claim 8, wherein the increased output power of the at least one active inverter is applied to all active induction coils associated therewith.

10. The induction cooktop of claim 8, wherein during the idling of the at least one selected inverter, the controller is configured to increase the output power of the at least one active inverter by an additional output power that is based on a pre-idle output power of the at least one selected inverter.

11. The induction cooktop of claim 10, wherein the additional output power is equal to the pre-idle output power of the at least one selected inverter that is applied to at least one associated induction coil that was active before and remains active after the idling of the at least one selected inverter.

12. The induction cooktop of claim 10, wherein the additional output power is less than the pre-idle output power of the at least one selected inverter that is applied to at least one associated induction coil that was active before and remains active after the idling of the at least one selected inverter.

13. The induction cooktop of claim 10, wherein the at least one active inverter decreases its output power over the course of a control period to offset the additional power applied during the idling of the at least one selected inverter.

14. The induction cooktop of claim 8, wherein the duration in which the at least one selected inverter is idled is set equal to an integer number of mains half-cycles.

15. A power delivery method for an induction cooktop, comprising the steps of:

providing a plurality of inverters, each of which is configured to apply an output power to a plurality of induction coils electrically coupled thereto via corresponding relays;

momentarily idling a selected inverter to enable commutation of a relay connected thereto; and increasing an output power of an active inverter for the duration in which the selected inverter is idled, thereby decreasing power fluctuations experienced on a mains line.

16. The power delivery method of claim 15, wherein the increased output power of the active inverter is applied to all active induction coils associated therewith.

17. The power delivery method of claim 15, wherein, during the idling of the selected inverter, the output power of the active inverter is increased by an additional output power that is based on a pre-idle output power of the selected inverter.

18. The power delivery method of claim 17, wherein the additional output power is equal to or less than the pre-idle output power of the selected inverter that is applied to at least one associated induction coil that was active before and remains active after the idling of the selected inverter.

19. The power delivery method of claim 17, further comprising the step of decreasing the output power of the active inverter over the course of a control period to offset the additional power applied during the idling of the selected inverter.

20. The power delivery system accordingly to claim 1, wherein the duration in which the selected inverter is in the idle state corresponds to a predetermined number of mains half-cycles of a mains voltage supplied to the induction cooktop.

* * * * *